US008621665B1

(12) United States Patent
Lowney

(10) Patent No.: US 8,621,665 B1
(45) Date of Patent: Jan. 7, 2014

(54) NOVELTY MITT

(76) Inventor: Jeremiah Joseph Lowney, Milton, MA (US)

( * ) Notice: Subject to any disclaimer, the term of this patent is extended or adjusted under 35 U.S.C. 154(b) by 245 days.

(21) Appl. No.: 12/898,200

(22) Filed: Oct. 5, 2010

Related U.S. Application Data

(60) Provisional application No. 61/302,447, filed on Feb. 8, 2010, provisional application No. 61/248,578, filed on Oct. 5, 2009.

(51) Int. Cl.
*A41D 13/08* (2006.01)
*A41D 19/00* (2006.01)
*A63B 71/14* (2006.01)

(52) U.S. Cl.
USPC ..... 2/19; 2/161.1

(58) Field of Classification Search
USPC ..... 2/16, 19, 20, 158, 159, 160, 161.1, 2/161.6, 163; 294/25; 446/26, 28; 441/55, 56, 57, 58, 59; 15/227; 473/455, 458, 508, 573, 596, 597, 598, 473/599; D29/115, 123
See application file for complete search history.

(56) References Cited

U.S. PATENT DOCUMENTS 862,760 A * 8/1907 Rumrill ..... 2/19
1,358,823 A * 11/1920 Burden ..... 2/163
1,535,896 A 4/1925 Bociek
1,562,176 A 11/1925 Latina
3,885,249 A * 5/1975 De Brabander ..... 15/227
4,471,495 A * 9/1984 Kruse et al. ..... 2/162
4,665,561 A 5/1987 Aoki
5,379,460 A 1/1995 Aoki
5,452,478 A * 9/1995 Rombach et al. ..... 2/161.6
5,592,688 A 1/1997 LaRonge
D381,129 S 7/1997 Lawrence
5,706,519 A 1/1998 Cooper
5,956,770 A * 9/1999 Dennis ..... 2/160
6,108,817 A 8/2000 Kostelac
6,324,696 B1 12/2001 Montgomery
6,353,931 B1 * 3/2002 Gilligan et al. ..... 2/19
2007/0113321 A1 * 5/2007 Drab ..... 2/209

* cited by examiner

*Primary Examiner* — Shelley Self
*Assistant Examiner* — Jameson Collier
(74) *Attorney, Agent, or Firm* — Steven N. Fox, Esq.

(57) ABSTRACT

The present invention is a novelty mitt to be worn on a person's hand at a sporting event such as baseball game. In one embodiment, the novelty mitt comprises a flexible base having inner and outer surfaces, left and right edges, and a bottom edge. The flexible base further comprises a lower portion, a left upper portion, a central upper portion, and a right upper portion. The central upper portion is spaced apart and disposed between the left and right upper portions. The outer surface of the left and right upper portions are removably engaged with the inner surface of the central upper portion to form the curved shape of the novelty mitt. The novelty mitt further comprises first, second, third, fourth and fifth finger pockets removably engaged with the outer surface of the flexible base to accommodate different size hands. The novelty mitt further comprises a wrist strap removably engaged with the lower portion of the flexible base to secure the novelty mitt to the person's hand.

18 Claims, 13 Drawing Sheets

NOVELTY MITT

CROSS-REFERENCE TO RELATED APPLICATIONS

This application claims priority to U.S. Provisional Application Ser. No. 61/248,578 filed on Oct. 5, 2009, now pending, and U.S. Provisional Application Ser. No. 61/302,447 filed on Feb. 8, 2010, now pending, both of which are hereby incorporated by reference in its entirety into this specification.

BACKGROUND OF THE INVENTION

The present invention relates to novelty mitts worn by people at sporting events such as baseball games. Various mini mitts have been designed. However, such conventional mini mitts are not designed for optimum comfort, versatility, ease of use, and fabrication.

SUMMARY OF THE INVENTION

The present invention is a novelty mitt to be worn on a person's hand at a sporting such as a baseball game. In one embodiment, the novelty mitt comprises a one piece unitary flexible base having inner and outer surfaces, left and right edges, and a bottom edge. The flexible base further comprises a lower portion, a left upper portion, a central upper portion, and a right upper portion. The central upper portion is spaced apart and disposed between the left and right upper portions. The outer surface of the left and right upper portions are removably engaged with the inner surface of the central upper portion to form the curved shape of the novelty mitt. The novelty mitt further comprises first, second, third, fourth and fifth finger pockets removably engaged with the outer surface of the flexible base to accommodate left and right hands having different hand sizes. The novelty mitt further comprises a wrist strap removably engaged with the lower portion of the flexible base to secure the novelty mitt to the person's hand. The novelty mitt can be fabricated at a significantly low cost and be comfortable, versatile and easy to use.

BRIEF DESCRIPTION OF THE DRAWINGS

The following description of the invention will be fully understood with reference to the accompanying drawings in which.

DESCRIPTION OF THE INVENTION

Figure 1:
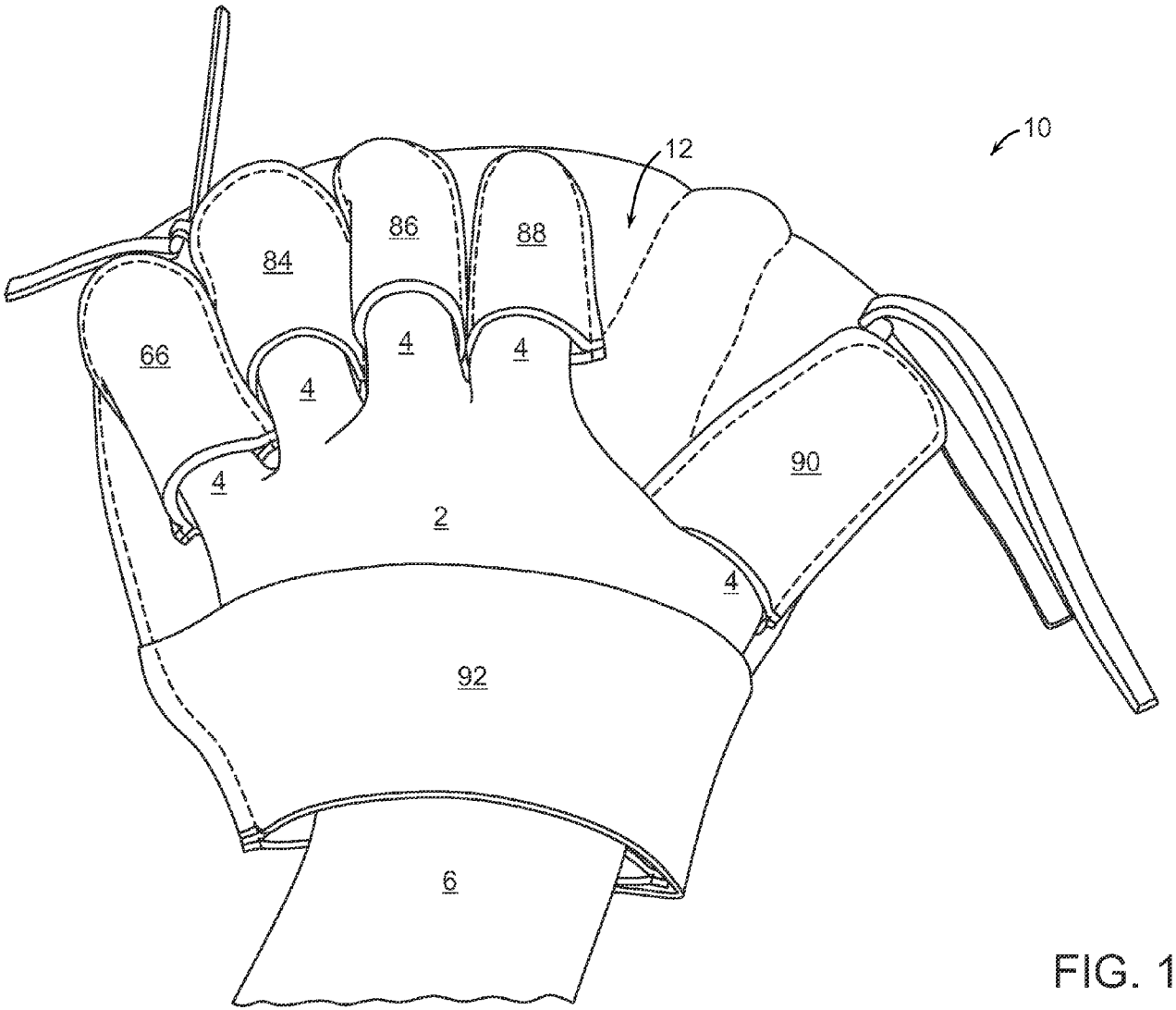
FIGS. 1 and 2 are top perspective views of a mitt according to a first embodiment of the present invention worn about a person's left and right hands, respectively.
Figure 2:
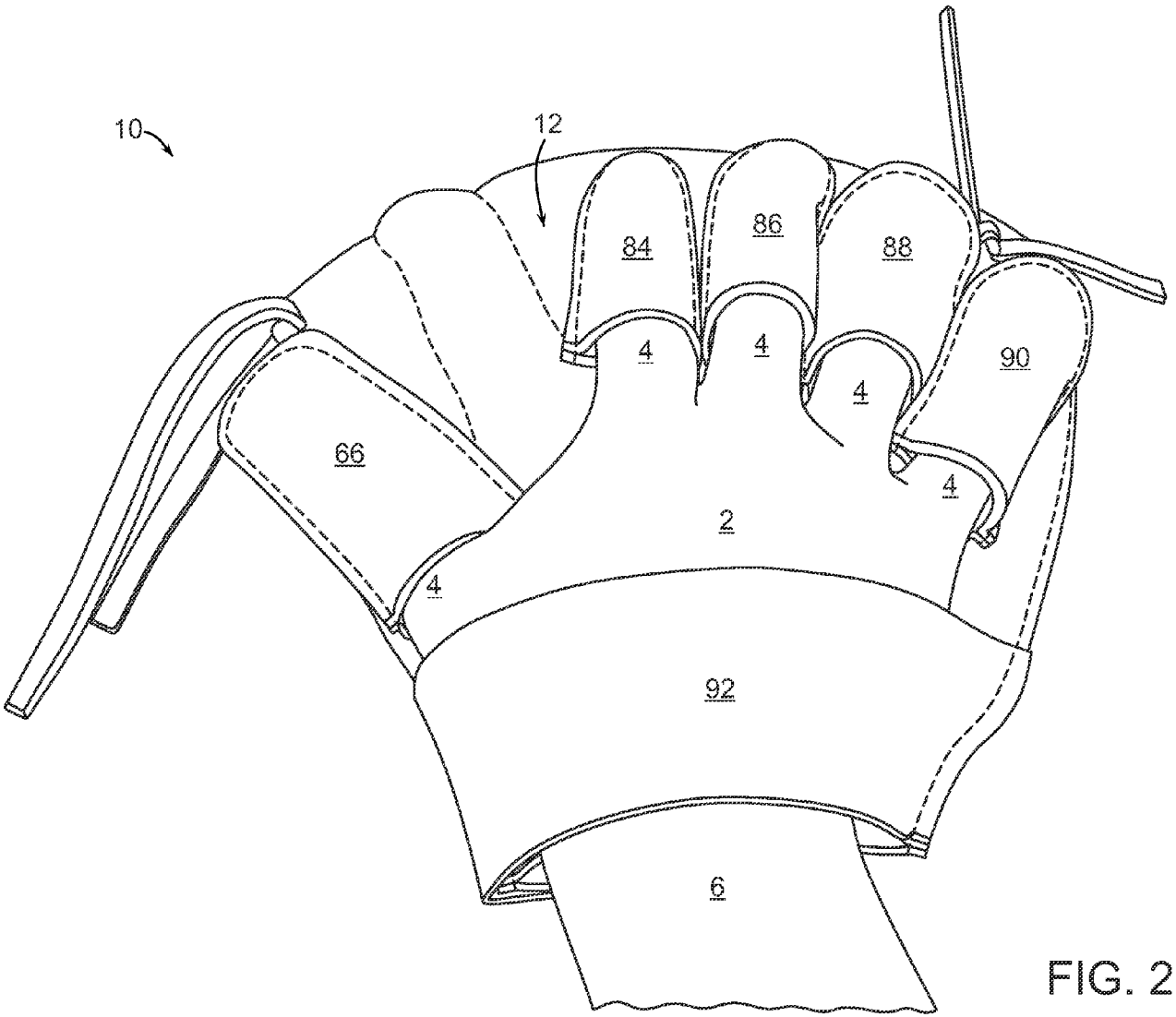

Referring to FIGS. 1-2, a first embodiment of a novelty mitt 10 according to the present invention is shown worn on a hand 2 of a person. Novelty mitt 10 may be worn on a person's left hand (FIG. 1) or right hand (FIG. 2). Novelty mitt 10 generally comprises a flexible base 12, adjustable finger pockets 66, 84, 86, 88 and 90, and a wrist strap 92. Finger pockets 66, 84, 86, 88 and 90 are removably engaged with and adjustably positioned on flexible base 12 so as to comfortably receive fingers 4 of hand 2. Wrist strap 92 is engaged with flexible base 12 and may be wrapped about wrist 6 to secure novelty mitt 10 to hand 2. Novelty mitt 10 may be used at a variety of sporting events such as a baseball game and/or corporate events or the like.

Figure 3:
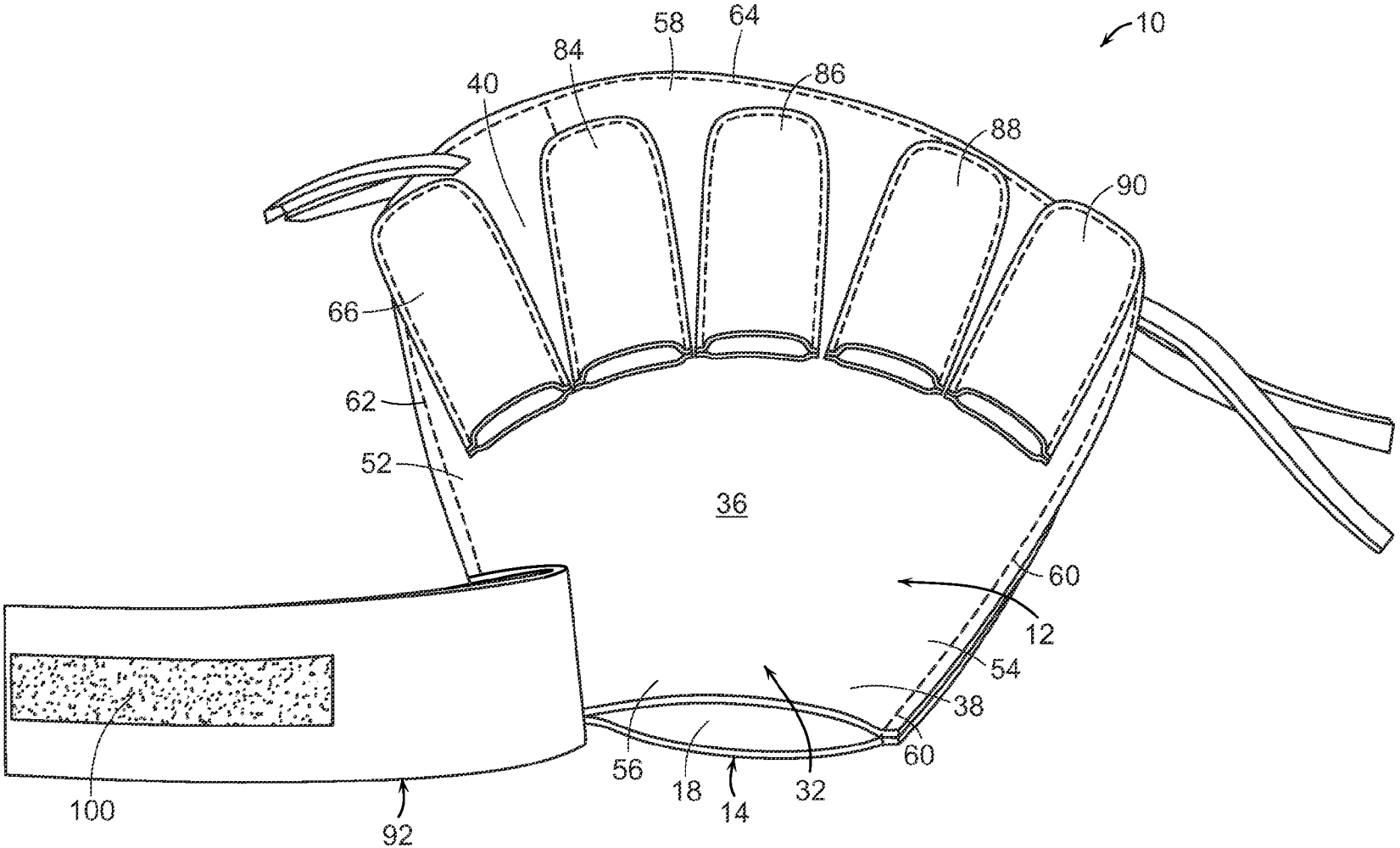
FIG. 3 is a top view of the mitt according to the first embodiment of the present invention.
Figure 4:
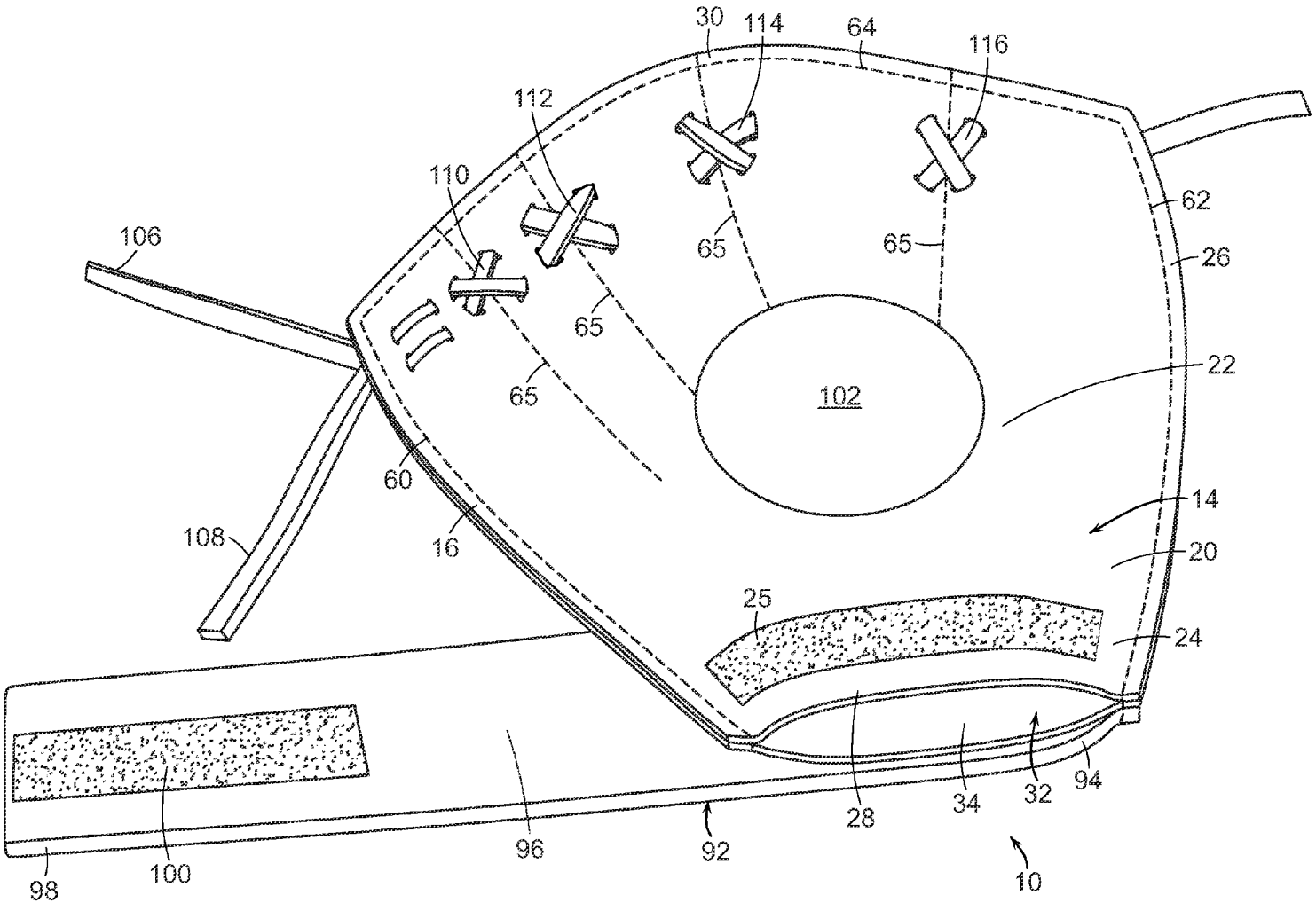
FIG. 4 is a bottom view of the mitt according to the first embodiment of the present invention.

Referring to FIGS. 3-4, flexible base 12 comprises a flexible lower layer 14 and a flexible upper layer 32. Lower layer 14 comprises an inside surface 18 (FIG. 3) and an outside surface 20 (FIG. 4). Outside surface 20 has a central portion 22 and a lower portion 24. Lower layer 14 further comprises a left edge portion 16, a right edge portion 26, a bottom edge portion 28, and a top edge portion 30. Upper layer 32 comprises an inside surface 34 (FIG. 4) and an outside surface 36 (FIG. 2). Outside surface 36 has lower and upper portions 38 and 40. Upper layer 32 further comprises a left edge portion 52, a right edge portion 54, a bottom edge portion 56, and a top edge portion 58. Left edge portion 16 of lower layer 14 is fastened to right edge portion 54 of upper layer 32 by stitching 60. Right edge portion 26 of lower layer 14 is fastened to left edge portion 52 of upper layer 32 by stitching 62. Top edge portion 30 of lower layer 14 is secured to top edge portion 58 of upper layer 32 by stitching 64. Inside surface 18 of lower layer 14 faces inside surface 34 of upper layer 32. Lower and upper layers 14 and 32 are made from a neoprene material having a thickness of about five millimeters (5 mm). The neoprene material is available as "Textured Raw Neoprene" from www.foamorder.com, FoamOrder.Com, 1325 Howard Street, San Francisco, Calif. 94103. One side of the neoprene sheet has a smooth surface and the other side has a course finish. The neoprene layer is orientated such that the palm side of mitt 10 has the course finish for external gripping.

With continued reference to FIG. 4, flexible base 10 further comprises nylon stitching 65 attaching lower and upper layers 14 and 32 to create the appearance of fingers of an actual baseball glove. The fingers are spaced evenly about two (2) inches apart and appear as five (5) separate fingers. Novelty mitt 10 is shell shaped and has a maximum length of about nine (9) inches and a maximum height of about nine (9) inches.

With continued reference to FIG. 4, flexible base 12 further comprises first and second strings 106 and 108 stitched across each other along upper portion 21 of lower layer 14 (palm side of mitt 10) to give the appearance of leather strings on a real baseball glove. The stitching of the neoprene strings 106 and 108 is tight enough to create a curve at the fingertip region of the palm side of novelty mitt 10 giving a shell shaped appearance. Strings 106 and 108 only show on inside surface 20 (palm side) of novelty mitt 10 similar to a leather baseball glove. Strings 106 and 108 cross at sections 110, 112, 114, and 116 which are substantially over stitches 65. This also provides the appearance of a leather baseball glove where the leather stitching keeps the actual fingers pockets together. Strings 106 and 108 are made from neoprene. Strings 106 and 108 have a width of about 0.25 inches and a length of about twelve (12) inches.

Figure 5:
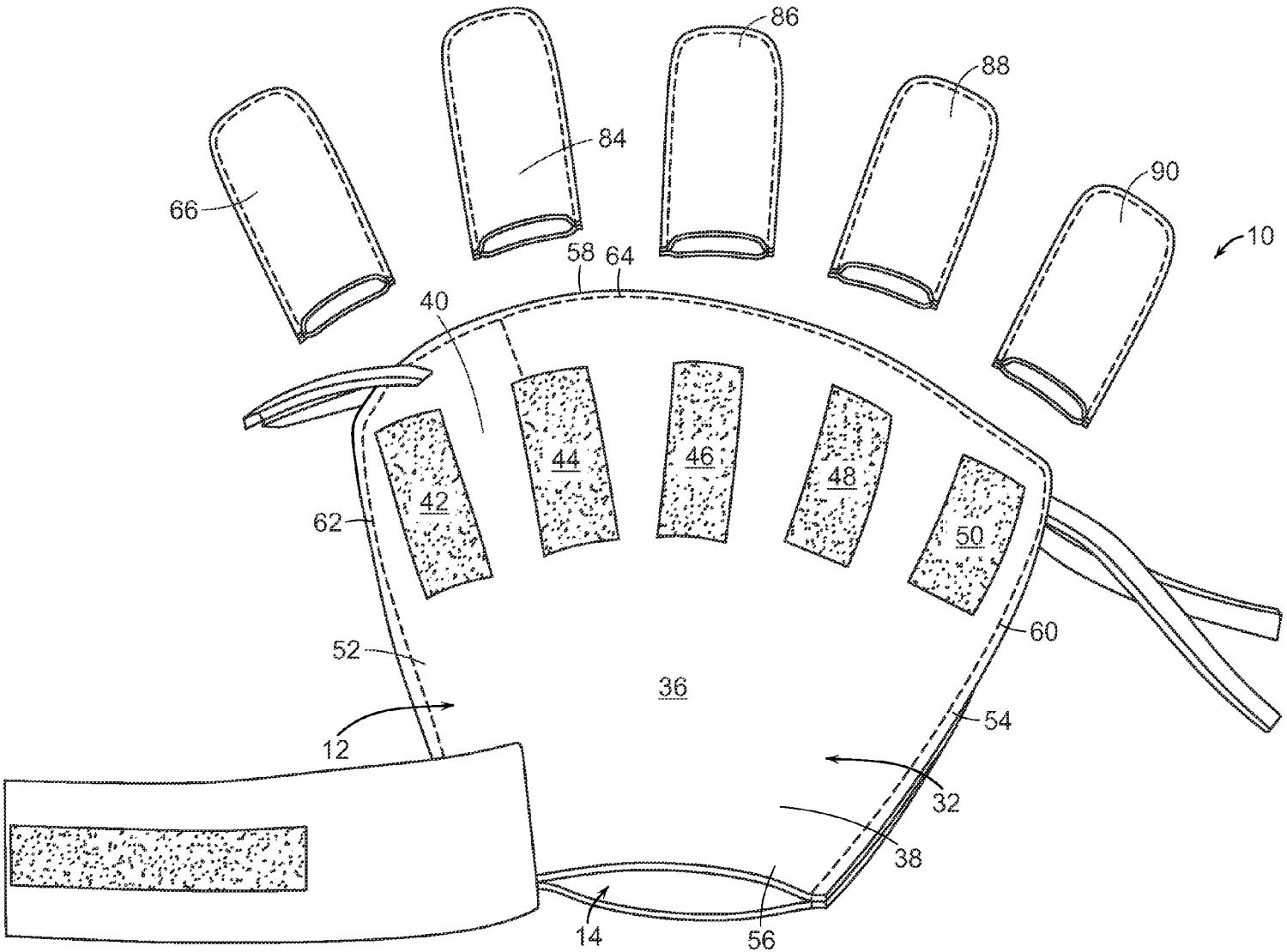
FIG. 5 is a top view of the mitt according to the first embodiment of the present invention.

Referring to FIG. 5, upper layer 32 further comprises fasteners 42, 44, 46, 48, and 50 attached to upper portion 40 in adjacent position by conventional means such as adhesive or threads. As will be described more fully herein, finger pockets 66, 84, 86, 88, and 90 are removably and adjustably engaged with fasteners 42, 44, 46, 48 and 50, respectively. Fasteners 42, 44, 46, 48, and 50 are well known hook or loop type fasteners.

Figure 7:
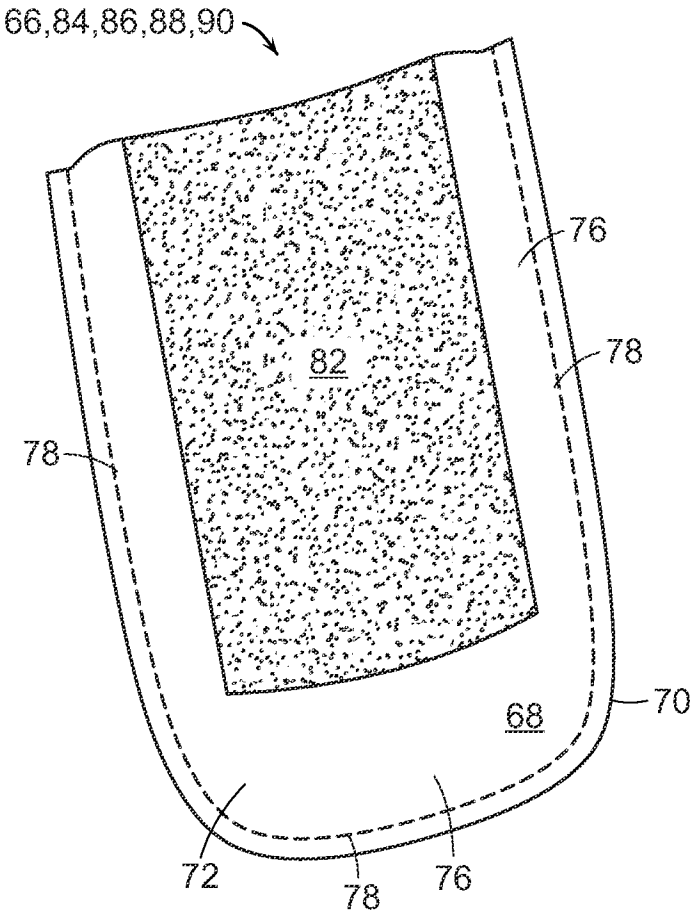
FIG. 7 is a bottom view of the finger pocket.
Figure 6:
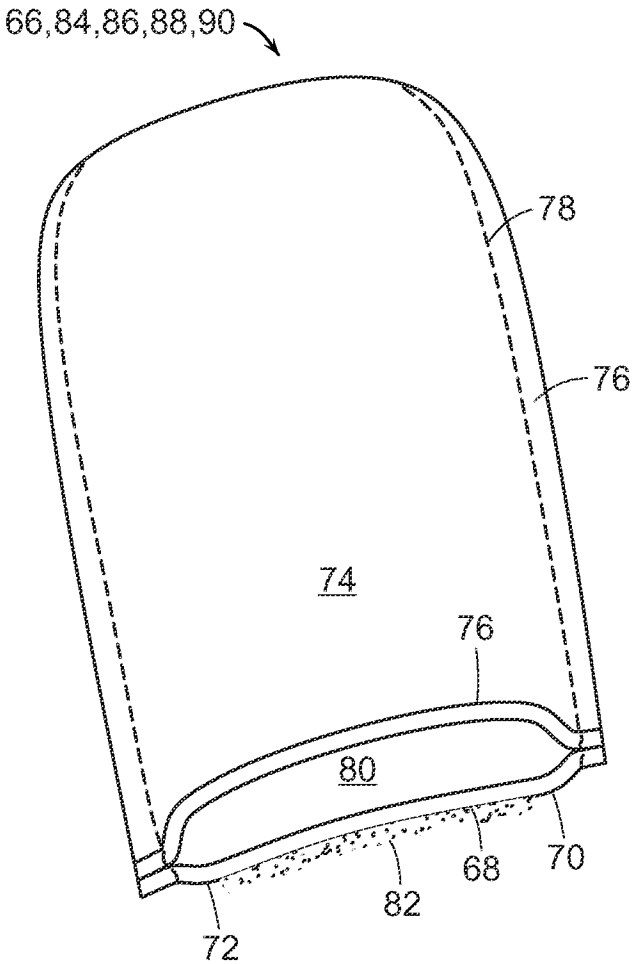
FIG. 6 is a perspective view of a finger pocket according to the first embodiment of the present invention.

Referring to FIGS. 6 and 7, finger pockets 66, 84, 86, 88 and 90 are removably engaged with fasteners 42, 44, 46, 48 and 50 of upper layer 32 so as to comfortably receive the person's fingers. Each of finger pockets 66, 84, 86, 88 and 90 comprise a base portion 68 having a peripheral edge 70 and a bottom outside surface 72. Each of finger pockets 66, 84, 86, 88 and 90 further comprise a body portion 74 attached to base portion 68. Body portion 74 comprises a peripheral edge 76 attached to peripheral edge 70 by stitches 78 to form an open end cavity 80. Each of finger pockets 66, 84, 86, 88, and 90 further comprise a fastener 82 attached to bottom outside surface 72 of base portion 68 adapted to engage with fasteners 42, 44, 46, 48, and 50 of upper layer 32. As shown by FIGS. 3 and 5, second finger pocket 84 is positioned adjacent first finger pocket 66. Third finger pocket 86 is positioned adjacent second finger pocket 84. Fourth finger pocket 88 is positioned adjacent said third finger pocket 86. Fifth finger pocket 80 is positioned adjacent fourth finger pocket 88. Fastener 82 may be a Velcro brand hook or loop type fastener. Fingers 66, 84, 86, 88 and 90 are made from neoprene (3 mm) polished finish and sewn by conventional methods. Each of the finger pockets have a length of three (3) inches and a width of one and one-half (1.50) inches. Each of the finger pockets have a one (1) inch open end 80 for easy introduction of the person's fingers and thumb. Each of the finger pockets are removable and adjustable for adult and child size hands. The top of the finger pockets are rounded. Novelty mitt 10 can be used on the left or right hand by adjusting the fingers and thumb for appropriate comfort and size.

With reference to FIG. 4, wrist band or strap 92 is adapted to secure the wrist of the person's hand to flexible base 12. Strap 92 comprises a first end portion 94 secured to right edge portion 26 of flexible lower layer 14 and/or left edge 52 of upper flexible layer 32 by conventional means such as nylon stitching. Strap 92 further comprises a central portion 96 and a free end portion 98. Strap 92 further comprises a fastener 100 adapted to removably engage with a fastener 25 of flexible lower layer 14. Fastener 100 may be a Velcro brand hook or loop type fastener. Strap 92 is made from neoprene having a width of two (2) inches and a thickness of three millimeters (3 mm). Strap 92 wraps around the wrist region 6 (FIG. 1) of the person's hand 2 whereby fastener 100 is removably engaged with fastener 25 (FIG. 5) of flexible lower layer 14.

With continued reference to FIG. 4, mitt 10 further comprises a decal 102 attached by conventional means such as adhesive to central portion 22 of lower layer 14. Decal 102 has a team/company logo stamped on a three (3) inch diameter coarse neoprene patch having a thickness of three (3) millimeters. Decal 102 is glued to the palm of the mitt with a strong adhesive. Decal 102 is slightly curved to help the overall mitt 10 with its palm curved appearance.

With reference to FIG. 5, mitt 10 may further comprise a decal (not shown) promoting a team or company name attached by conventional means such as screen printing to one or more of finger pockets 66, 84, 86, 88, and 90.

Figure 8:
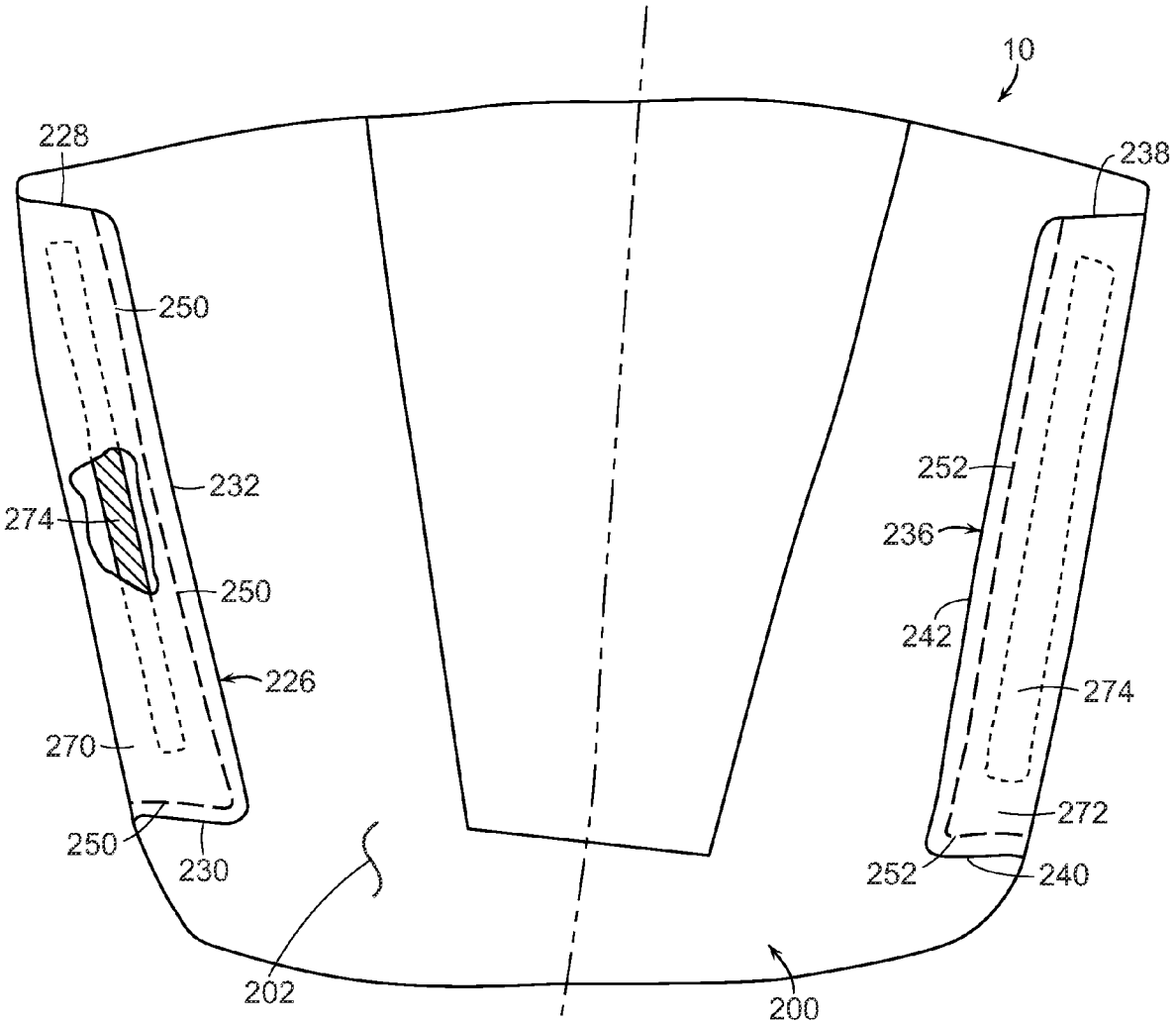
FIGS. 8 and 9 are bottom and top perspective views of a novelty mitt according to a second embodiment of the present invention formed from a single blank or sheet made from neoprene material.
Figure 9:
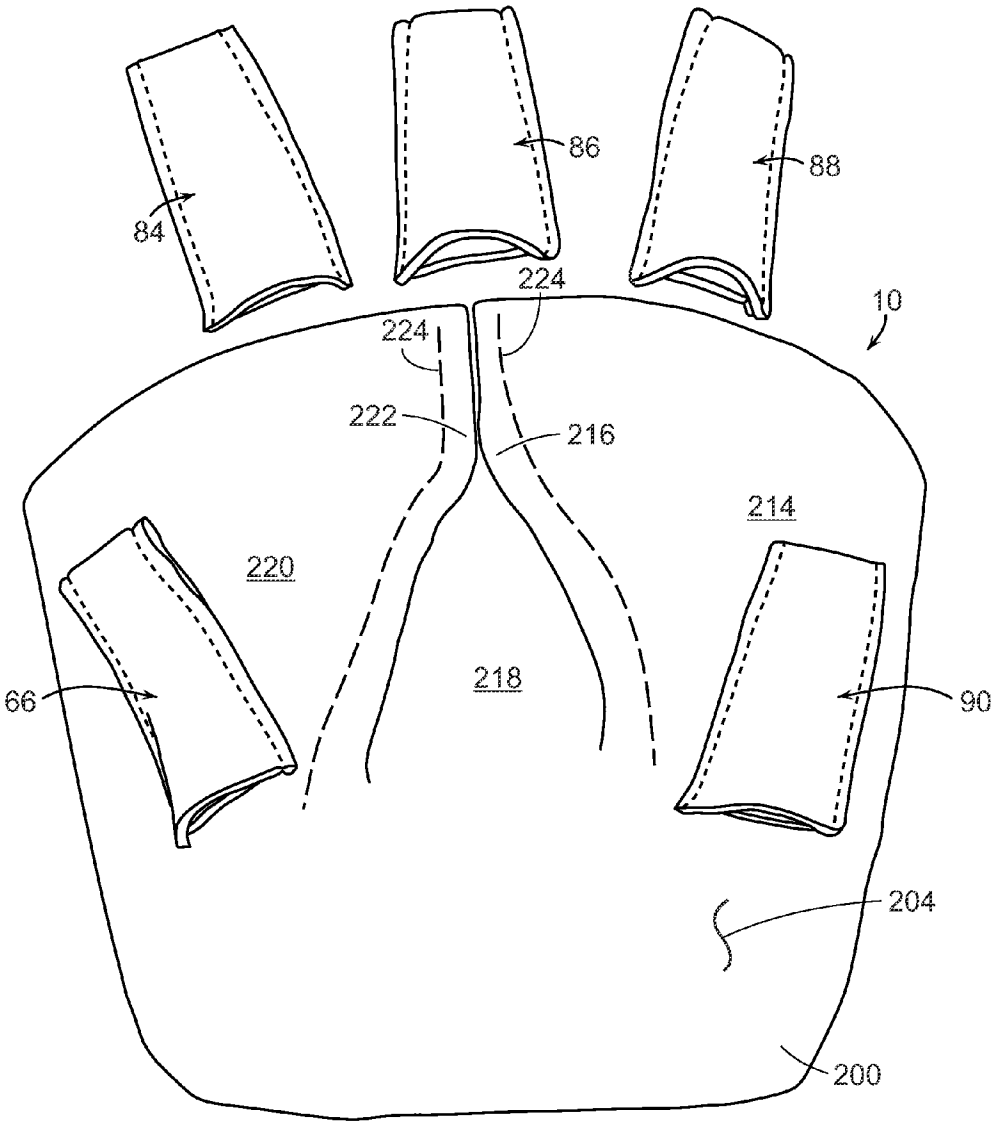

Referring to FIGS. 8-9, where a second embodiment of novelty mitt 10 is shown formed from a single blank or sheet 200 of neoprene material having a thickness of about five (4) millimeters. Sheet 200 has front and back sides 202 and 204. FIG. 8 is a front perspective view of mitt 10 formed from single blank 200. FIG. 9 is a rear perspective view of mitt 10 formed from single blank 200. As will be described more fully herein, mitt 10 is formed by single blank 200 to have pockets 270 and 272 on front side 202 of novelty mitt 10. A stiffener 274 made from plastic or wood is disposed in pockets 270 and 272. Stiffener 274 may be inserted into an open top end of pockets 270 and 274 or sewn in place.

Figure 10:
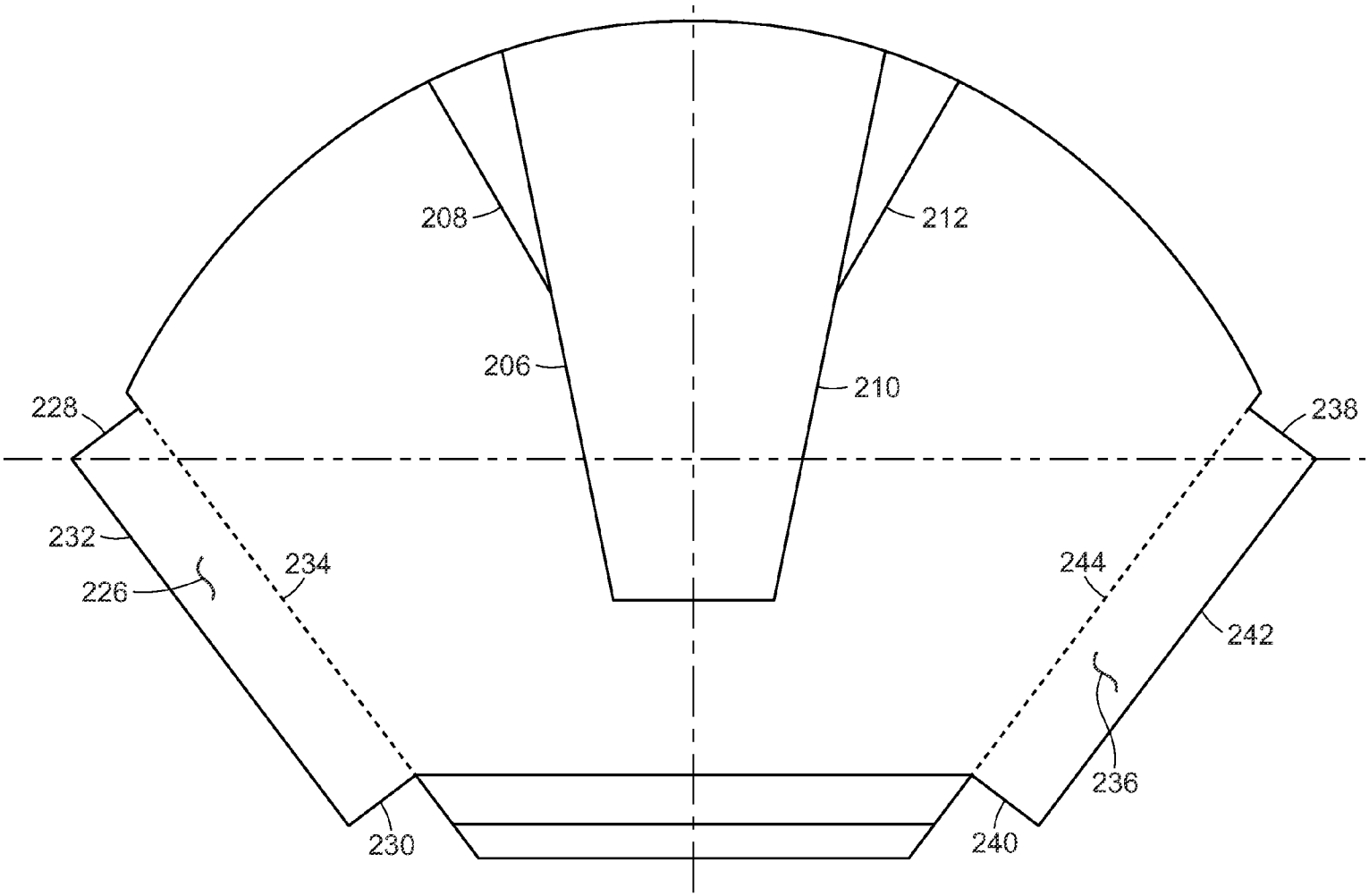
FIG. 10 is a plan view of the single blank prior to cutting.
Figure 11:
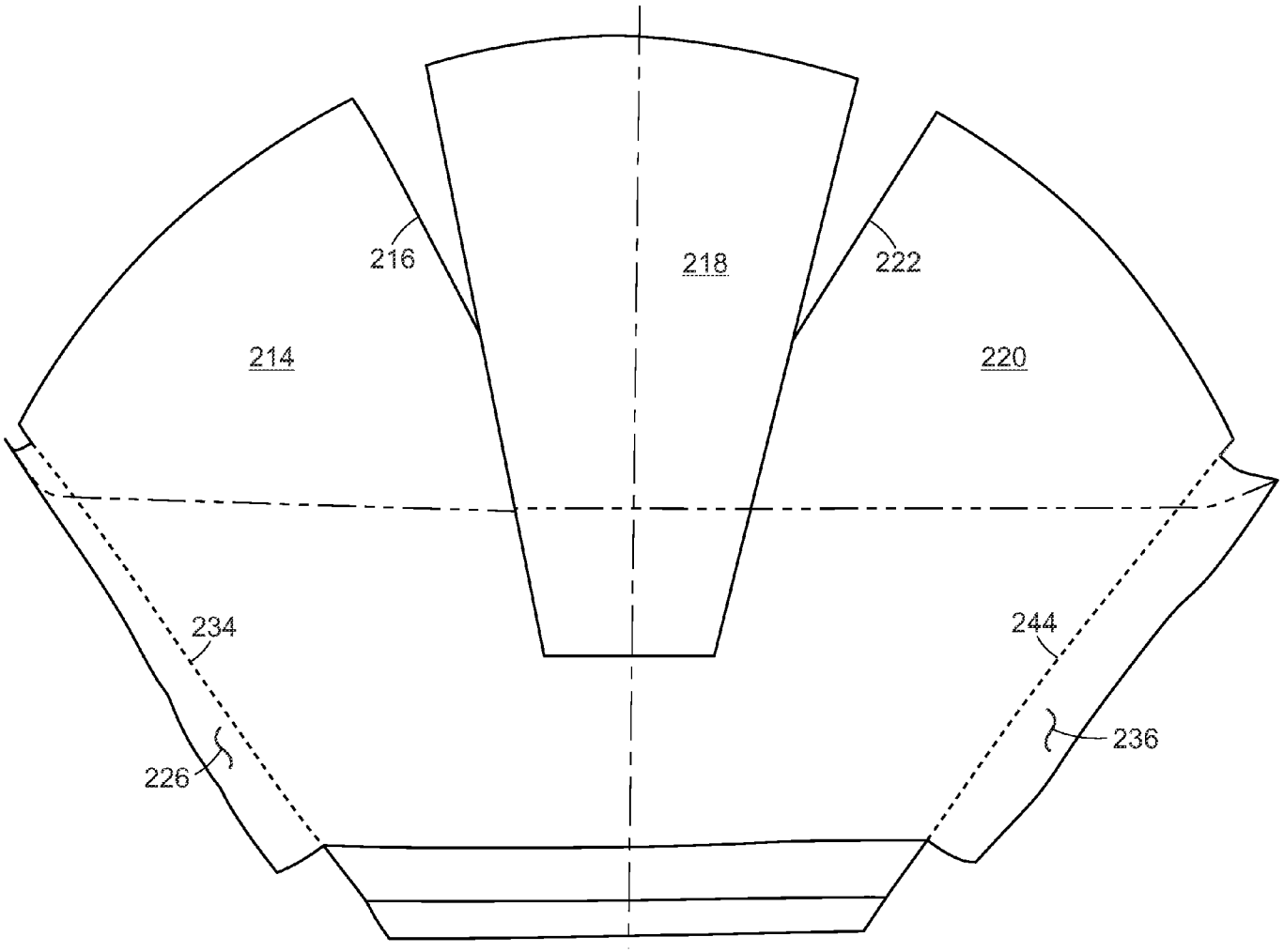
FIG. 11 is a perspective view of a partially cut and folded single blank.

Referring to FIG. 10, where single blank 200 is shown prior to cutting, folding, and sewing. Blank 200 comprises cutlines 206, 208, 210, and 212. As shown by FIG. 11, when cuts are made along lines 206, 208, 210, and 212, blank 200 is formed into three (3) sections: a left section 214 having inside edge 216, a central section 218; and a right section 220 having an inside edge 222. As best shown by FIG. 9, the inside edges 216 and 222 of left and right sections 214 and 220, respectively, are folded and secured to the back side of section 218 about its centerline by stitching 224 to form a shell shape. As shown, stitching 224 may run along the entire length of inside edges 216 and 222. Alternatively, inside edges 216 and 222 of left and right sections 214 and 220, respectively, are bent and secured to the front or palm side of section 218 about its centerline by stitching to form the shell shape. In this case, the stitching may likewise be extended along the entire length of inside edges 216 and 222. This alternative embodiment tends to exhibit greater inward flexibility of left and right sections 214 and 220 that will aid the person when closing the novelty mitt 10.

Referring to FIGS. 10 and 11, blank 200 has a left flap 226 having top and bottom edges 228 and 230, a side edge 232, and a fold line 234. Blank 200 further comprises a right flap 236 having top and bottom edges 238 and 240, a side edge 242, and a fold line 244. FIG. 11 shows flaps 226 and 236 partially folded about fold lines 234 and 244, respectively. As best shown by FIG. 8, left flap 226 is folded upon front side 202 of the blank 200 and secured by stitching 250 about bottom edge 230 and side edge 226 to form pocket 302. Top edge 228 is left open to allow insert of stiffener 274. Similarly, right flap 236 is folded upon front side 202 of the blank 200 and secured by stitching 252 about bottom edge 240 and side edge 242 to form pocket 304. Top edge 238 is left open to allow insert of stiffener 274. Alternatively, left and right flaps 226 and 236 may be folded upon the back of mitt 10. However, this alternative positioning may decrease the inward flexibility of sections 214 and 220.

With continued reference to FIGS. 10 and 11, the width of blank 200 is about fifteen (15) inches and the height is about ten (10) inches. Each of the three clovers or sections 214, 218, and 220 are about five (5) inches wide at the top. Cut lines 206 and 210 are about six and one-half (6.5) inches in length from the top at a medial angle. Cut lines 208 and 212 are about three (3) inches from the top at a medial angle leaving a one (1) inch space between section 214 and section 218 and a one (1) inch spacing between sections 218 and 220. Flaps 226 and 236 each have a length of about five (5) inches and a width of about one (1) inch. Stiffener 274 has a length of about four and one-half (4.5) inches and a width of about three-quarter (¾) inch. Although not shown in FIGS. 8-11, a velcro wrist band may be sewn or otherwise attached to the back side of mitt 10 as described in connection with the first embodiment. As shown in FIG. 9, mitt 10 further comprises five (5) removable and adjustable 1 mm thick neoprene finger slots (3 inches×1 inch) 66, 84, 86, 88, and 90 removably engaged or attached to the back side 204 of mitt 10 by velcro fasteners as previously described in the first embodiment of mitt 10.

Figure 12:
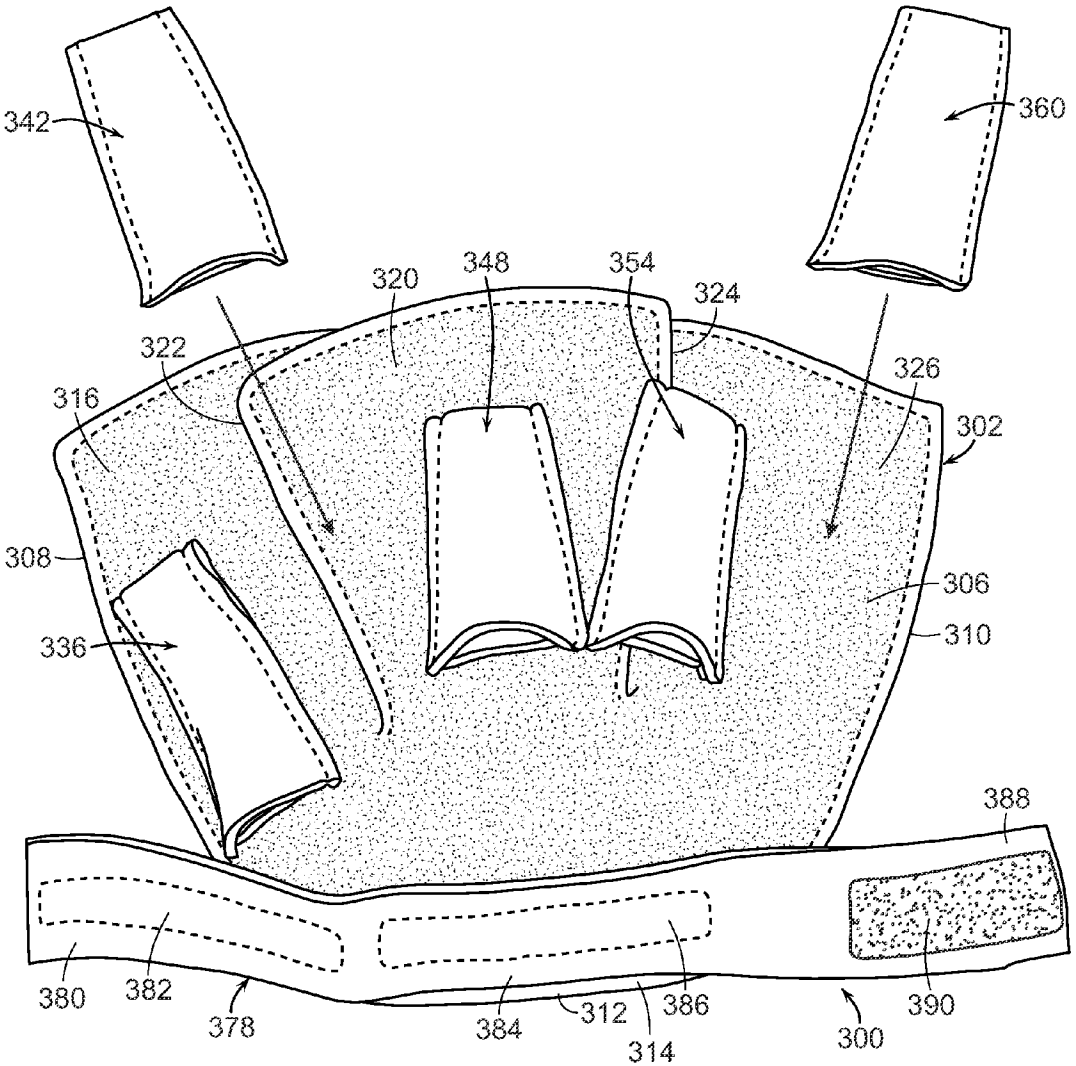
FIGS. 12 and 13 are top and bottom views of a novelty mitt according to a third embodiment of the present invention.

Referring to FIG. 12, where a third embodiment of novelty mitt 300 may be formed from a single blank sheet of neoprene material. Novelty mitt 300 generally comprises a one piece unitary flexible base 302, a first finger pocket 336, a second finger pocket 342, a third finger pocket 348, a fourth finger pocket 354, a fifth finger pocket 360, and a wrist strap 378.

Figure 13:
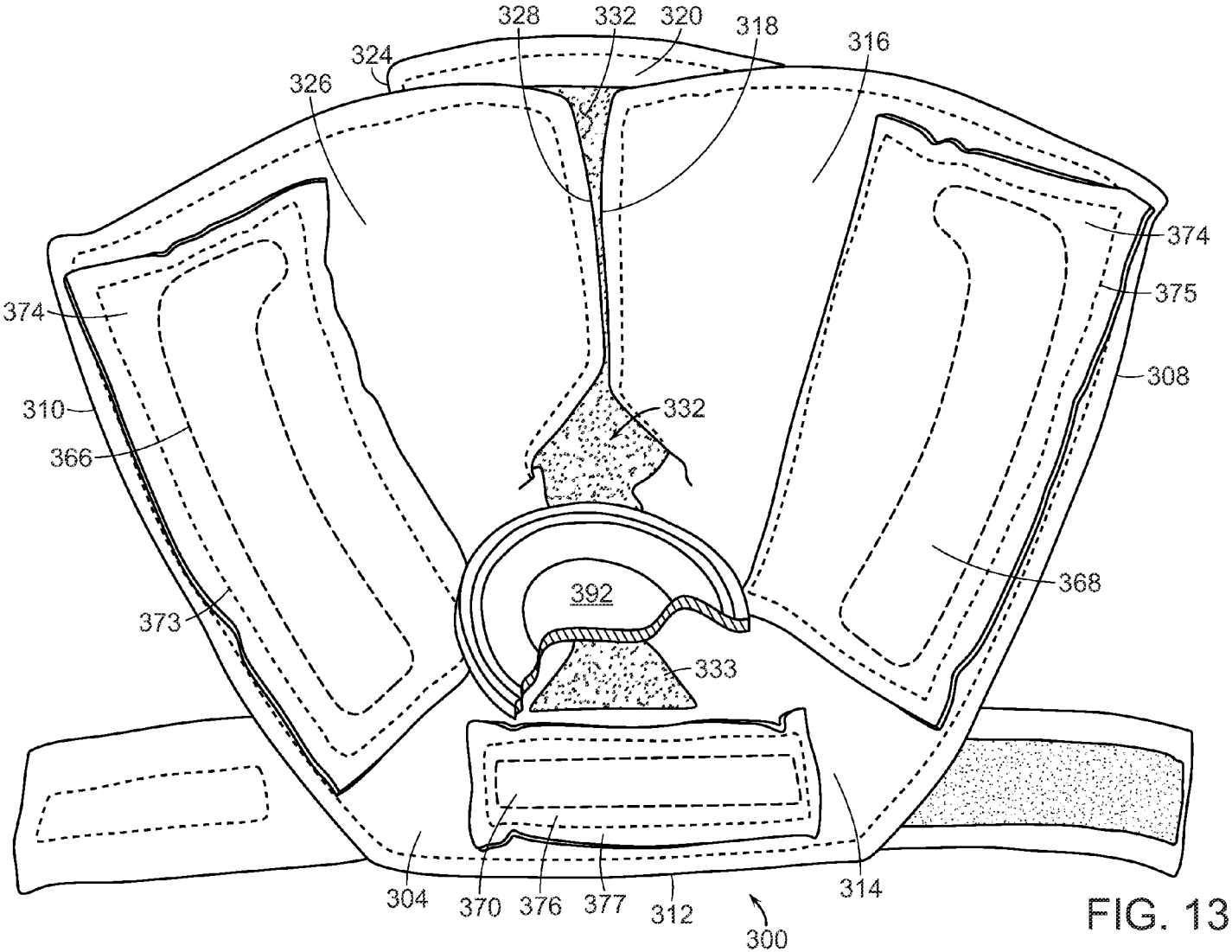
Figure 14:
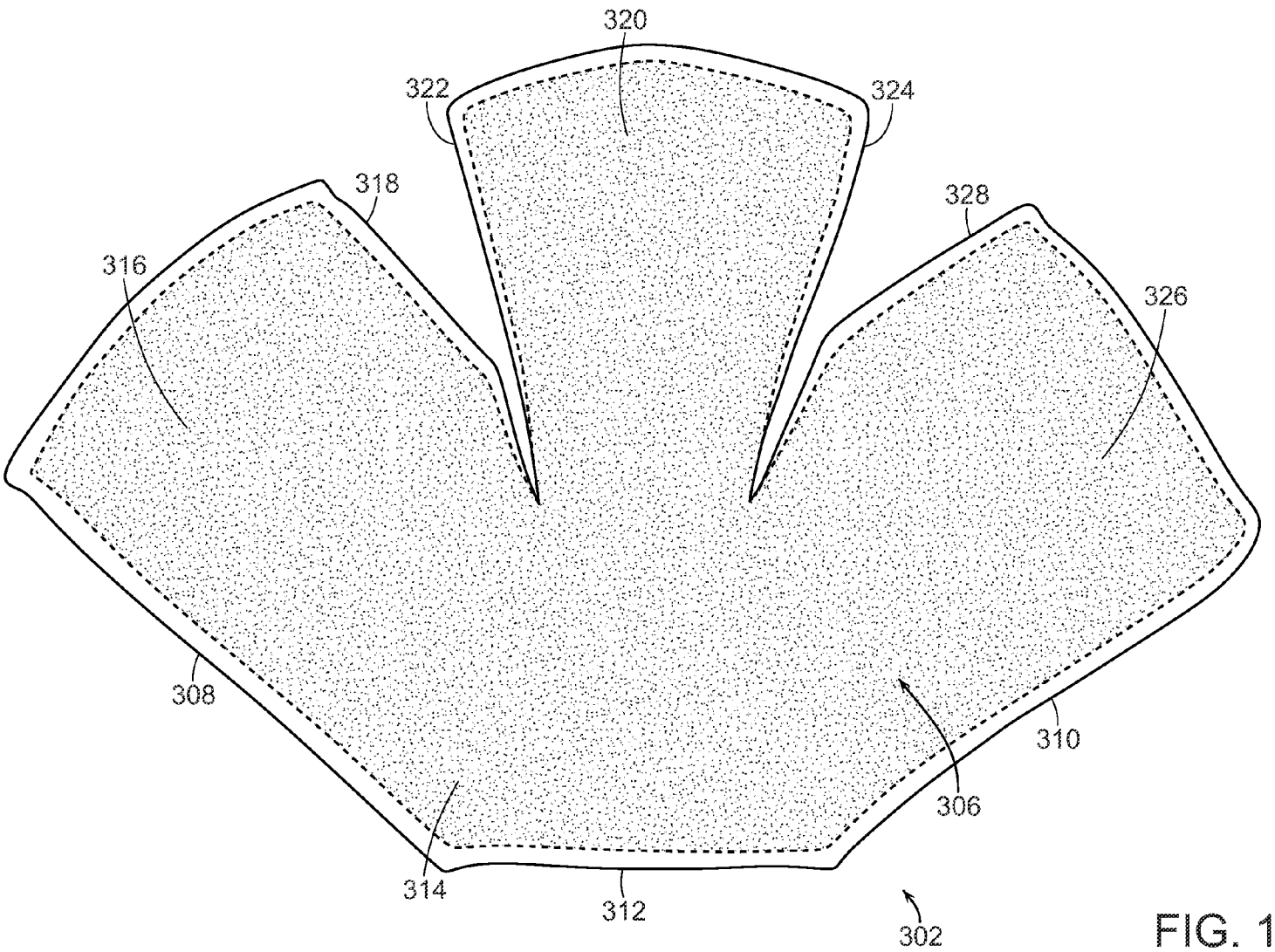
FIG. 14 is a top view of the novelty mitt according to the third embodiment of the present invention showing a cut-blank prior to folding.

Referring to FIGS. 12-14, flexible base 302 comprises an inner surface 304, an outer surface 306, a left edge 308, a right edge 310, and a bottom edge 312. Flexible base 302 further comprises a lower portion 314 disposed adjacent bottom edge 312. Flexible base 302 further comprises a left upper portion 316 disposed adjacent left edge 308. Left upper portion 316 has an inner edge 318. Flexible base 302 further comprises a right upper portion 326 disposed adjacent right edge 310. Right upper portion has an inner edge inner edge 328. Flexible base 302 further comprises a central upper portion 320 spaced apart and disposed between left and right upper portions 316 and 326. Central upper portion 320 has inner edges 322 and 324. Novelty mitt 300 further comprises a fastener 332 attached to inner surface 304 of flexible base 302. Fastener 332 is a well known and widely available hook type fastener. Outer surface 306 of left and right upper portions 316 and 326 are removably engaged with fastener 332 of central upper portion 320 to form the curved shape of novelty mitt 300. Outer surface 306 is formed and purchased pre-cut with loop type fasteners that removably engage with hook type fastener 332. Flexible base 302 is made a neoprene material having a thickness of about six millimeters (6 mm). The neoprene material is available as "6 mm noeprene with plain/textured front and u-loop backing" from www-.foamorder.com, FoamOrder.Com, 1325 Howard Street, San Francisco, Calif. 94103. Inner surface 304 (palm side) of the neoprene sheet (flexible base 302) has a course finish for gripping and an outer surface 306 is formed with loop type fasteners about its entire surface the removably engaged with hook type fasteners.

Finger pockets 336, 342, 348, 354 and 360 are of the same design as finger pockets 66, 84, 86, 88, and 90 previously described with reference to the first embodiment of novelty mitt 10 (FIGS. 5-7). Finger pockets 336, 342, 348, 354 and 360 may be moved anywhere about outer surface 306 allowing the person to adjust the finger pockets to conform to the person's hand.

Referring to FIG. 13, novelty mitt 300 further comprises a first stiffener 366 and disposed in a first pocket 374. First stiffener 366 assists in promoting and/or maintaining the curved shape of the novelty mitt 300. First pocket 372 may be attached to inner surface 304 of flexible base 302 by conventional means such as nylon threads 373.

With continued reference to FIG. 13, novelty mitt 300 further comprises a second stiffener 368 disposed in a second pocket 374. Second stiffener 368 assists in promoting and/or maintaining the curved shape of the novelty mitt 300. Second pocket 374 may be attached to inner surface 304 of flexible base 302 by conventional means such as nylon threads 375.

Novelty mitt 300 further comprises a third stiffener 370 disposed in a third pocket 376. Third stiffener 370 assists in promoting and/or maintaining the curved shape of the novelty mitt 300. Third pocket 376 may be attached to inner surface 304 of flexible base 302 by conventional means such as nylon threads 377.

Referring to FIGS. 12 and 13, wrist strap 378 comprises a left end portion 380, a central portion 384, and a right end portion 388. Central portion 384 has a fastener 386 that removably engages wrist strap 378 to outer surface 306 of flexible base 302. Fastener 386 is a hook type fastener and may be attached to central portion 384 by conventional means such as nylon threads. Left end 380 has a hook type fastener 382 attached to left end portion 384 by conventional mean such as nylon threads. Right end portion 388 has a loop type fastener 390 that is removably engages with fastener 382. Fasteners 382 and 384 may be attached to left and right end portions 380 and 388, respectively, by conventional means such as nylon threads.

Novelty mitt 300 further comprises a logo 392 removably attached a lower end portion 333 of fastener 332 to a fastener 394. Fastener 394 is attached to inner surface 304 of flexible base 302 by conventional means such as threads.

Novelty mitt 300 has many uses and applications. By way of example, novelty mitt 300 may be used at sporting events such as baseball games as a glove to catch a foul ball and/or a souvenir. By way of further example, novelty mitt 300 may be used as part of a child's wiffle ball game or the like.

The foregoing description is intended for purposes of illustration. The invention may be embodied in other forms or carried out in other ways without departing from the spirit or scope of the invention.

What is claimed:

1. A mitt comprising:

(a) a one piece unitary flexible base comprising inner and outer surfaces, left and right edges, a bottom edge, a lower portion adjacent said bottom edge, a left upper portion adjacent said left edge, a central upper portion, and a right upper portion adjacent said right edge; said central upper portion is spaced apart and disposed between said left and right upper portions; said left and right upper portions are removably engaged with said central upper portion to form an open pocket of the mitt;

(b) a first finger pocket comprising a fastener removably engaged with said outer surface of said flexible base; said first finger pocket further comprises a body portion comprising, the entire open end cavity positioned completely above said outer surface of said flexible base;

(c) a second finger pocket comprising a fastener removably engaged with said outer surface of said flexible base; said second finger pocket further comprises a body portion comprising, the entire open end cavity positioned completely above said outer surface of said flexible base; said second finger pocket is positioned adjacent said first finger pocket;

(d) a third finger pocket comprising a fastener removably engaged with said outer surface of said flexible base; said third finger pocket further comprises a body portion comprising, the entire open end cavity positioned completely above said outer surface of said flexible base; said third finger pocket is positioned adjacent said second finger pocket;

(e) a fourth finger pocket comprising a fastener removably engaged with said outer surface of said flexible base; said fourth finger pocket further comprises a body portion comprising, the entire open end cavity positioned completely above said outer surface of said flexible base; said fourth finger pocket is positioned adjacent said third finger pocket;

(f) a fifth finger pocket comprising a fastener removably engaged with said outer surface of said flexible base; said fifth finger pocket further comprises a body portion comprising, the entire open end cavity positioned completely above said outer surface of said flexible base; said fifth finger pocket is positioned adjacent said fourth finger pocket; and (g) a wrist strap engaged with said lower portion of said flexible base.

2. The mitt of claim 1, wherein said left upper portion comprises an inner edge.

3. The mitt of claim 2, wherein said central upper portion comprises left and right inner edges.

4. The mitt of claim 3, wherein said right upper portion comprises an inner edge.

5. The mitt of claim 4, wherein said inner edge of said left upper portion is removably engaged with said central upper portion.

6. The mitt of claim 5, wherein said inner edge of said right upper portion is removably engaged with said central upper portion.

7. The mitt of claim 6, wherein said inner edge of said left upper portion is disposed adjacent said inner edge of said right upper portion.

8. The mitt of claim 7, further comprising a first fastener attached to said central upper portion; said left and right upper portions are removably engaged with said first fastener.

9. The mitt of claim 8, wherein said wrist strap is removably engaged with said lower portion of said flexible base.

10. The mitt of claim 9, further comprising a first stiffener disposed adjacent said left edge of said flexible base.

11. The mitt of claim 10, further comprising a second stiffener disposed adjacent said right edge of said flexible base.

12. The mitt of claim 11, further comprising a third stiffener disposed adjacent said bottom edge of said flexible base.

13. The mitt of claim 12, further comprising a first pocket engaged with said flexible base and adjacent said left edge; said first stiffener is disposed in said first pocket.

14. The mitt of claim 13, further comprising a second pocket engaged with said flexible base and adjacent said right edge; said second stiffener is disposed in said second pocket.

15. The mitt of claim 14, further comprising a third pocket engaged with said flexible base and adjacent said bottom edge; said third stiffener is disposed in said third pocket.

16. The mitt of claim 15, wherein said first and second pockets are sewn to said flexible base.

17. A mitt comprising: a one piece unitary flexible base comprising inner and outer surfaces and shaped to form an open pocket of the mitt; a first finger pocket comprising a fastener removably engaged with said outer surface of said flexible base; said first finger pocket further comprises a body portion comprising, the entire open end cavity positioned completely above said outer surface of said flexible base; a second finger pocket comprising a fastener removably engaged with said outer surface of said flexible base; said second finger pocket further comprises a body portion comprising, the entire open end cavity positioned completely above said outer surface of said flexible base; said second finger pocket is spaced apart from and positioned adjacent said first finger pocket; a third finger pocket comprising a fastener removably engaged with said outer surface of said flexible base; said third finger pocket further comprises a body portion comprising, the entire open end cavity positioned completely above said outer surface of said flexible base; said third finger pocket is spaced apart from and positioned adjacent said second finger pocket; a fourth finger pocket comprising a fastener removably engaged with said outer surface of said flexible base; said fourth finger pocket further comprises a body portion comprising, the entire open end cavity positioned completely above said outer surface of said flexible base; said fourth finger pocket is spaced apart from and positioned adjacent said third finger pocket; and a fifth finger pocket comprising a fastener removably engaged with said outer surface of said flexible base; said fifth finger pocket further comprises a body portion comprising, the entire open end cavity positioned completely above said outer surface of said flexible base; said fifth finger pocket is spaced part from and positioned adjacent said fourth finger pocket.

18. The mitt of claim 17, further comprising a wrist strap engaged with said flexible base.

* * * * *